US006568401B1

(12) United States Patent
Salmon et al.

(10) Patent No.: US 6,568,401 B1
(45) Date of Patent: May 27, 2003

(54) PROCESS FOR PROVIDING CUT FILLER FOR CIGARETTES

(75) Inventors: Brian Salmon, St. Legier-la-Chiesaz (CH); Antonio Frattolillo, Tricase (IT)

(73) Assignee: Philip Morris Incorporated, New York, NY (US)

( * ) Notice: Subject to any disclaimer, the term of this patent is extended or adjusted under 35 U.S.C. 154(b) by 0 days.

(21) Appl. No.: 09/600,777

(22) PCT Filed: Jan. 14, 1999

(86) PCT No.: PCT/EP99/00276

§ 371 (c)(1),
(2), (4) Date: Oct. 5, 2000

(87) PCT Pub. No.: WO99/37173

PCT Pub. Date: Jul. 29, 1999

(30) Foreign Application Priority Data

Jan. 23, 1998 (EP) ..... 98300491

(51) Int. Cl.[7] ..... A24B 5/16; A24B 5/00

(52) U.S. Cl. ..... 131/315; 131/313; 131/324; 131/290

(58) Field of Search ..... 131/290, 312, 131/324, 313, 315, 314, 311, 299

(56) References Cited

U.S. PATENT DOCUMENTS 5,404,890 A * 4/1995 Gentry et al. ..... 131/342

FOREIGN PATENT DOCUMENTS

| | | | |
|---|---|---|---|
| DE | 27 19 088 | A | 11/1978 |
| DE | 90 00 291 | U | 3/1990 |
| EP | 0 539 064 | A | 4/1993 |
| EP | 0 651 951 | A | 5/1995 |
| FR | 2 373 239 | A | 7/1978 |
| GB | 951 485 | A | 12/1962 |
| GB | 2 268 919 | A | 1/1994 |
| WO | 90 05034 | A | 5/1990 |
| WO | 94 10864 | A | 5/1994 |

* cited by examiner

*Primary Examiner*—Steven P. Griffin
*Assistant Examiner*—Dionne A. Walls
(74) *Attorney, Agent, or Firm*—Burns, Doane, Swecker & Mathis, LLP

(57) ABSTRACT

A process for preparing tobacco stem for use as filler for a smoking article includes classifying the green tobacco stem by diameter to provide a plurality of stem grades and rolling each grade separately. Each grade is rolled under rolling conditions optimized for that grade including rolling the grade through the nip between rollers with the nip size being adjusted for each grade so as to achieve a uniform rolled stem thickness and the oven volatiles content of the stem being adjusted before the rolling. The yield of flat rolled stem which may be used directly as filler is increased, and the average stem length and thus the average length of cut filler from stem is increased.

24 Claims, 1 Drawing Sheet

PROCESS FOR PROVIDING CUT FILLER FOR CIGARETTES

Figure 1:
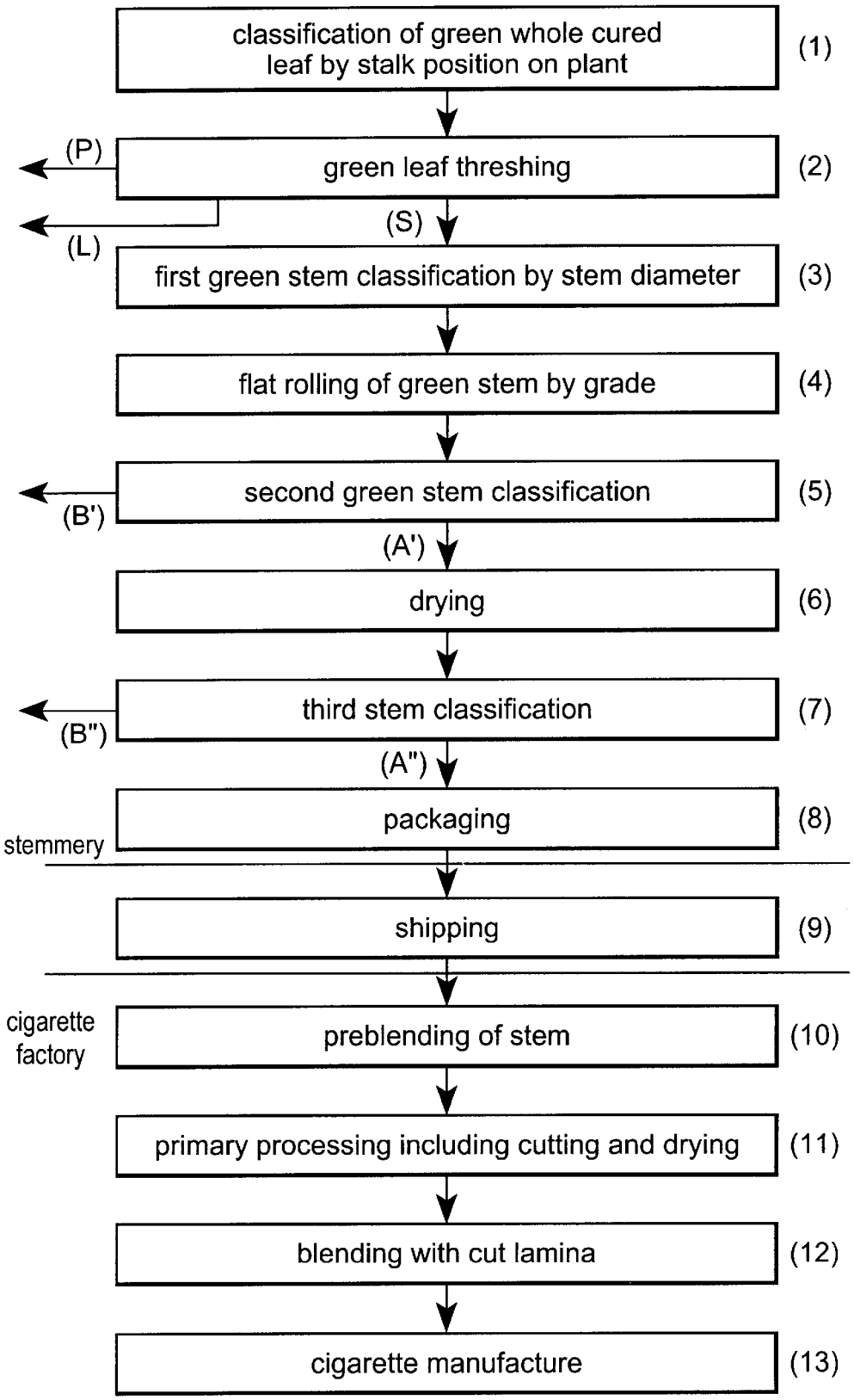

In the initial stages of the production of cut filler for smoking articles such as cigarettes, cured tobacco leaf is classified into top, middle and bottom leaf, the top leaves being those nearest the plant top, or mixtures thereof. These classes are further graded by quality and the resulting numerous grades of leaf are threshed to remove the leaf lamina from the stem or mid rib, and are redried and packed for shipment. Between curing and redrying, the leaf and stem are usually referred to as "green".

In conventional processes, the stem grades are classified by diameter and length, dried to an o.v. (oven volatiles content) of around 10 or 11% and classified into long stem pieces suitable for direct use, subject to primary processing in filler, and shorter stem pieces suitable for use in the manufacture of tobacco sheet. The stem is packaged for transport from the stemmery to the cigarette factory, which may well be in another country or continent. In the cigarette factory, the long stems for direct use as filler are preblended with other stems from the same and/or different sources, and subjected to primary processing including conditioning and soaking in water for a few hours followed by rolling flat, cutting and drying using known techniques. The cut dried stem is blended with cut tobacco lamina which has been subjected to a primary processing to provide a cut filler for cigarettes or other smoking articles.

In conventional processes, the stems are subjected to mechanical damage during rolling, because their structure has been weakened by the drying process and subsequent insufficient conditioning because of insufficient moisture penetration. The rolled stems are of different thicknesses because the stems prior to rolling are of different diameters, lengths and physical properties. This means that the final cut stem filler for blending with cut lamina filler are not of optimal quality.

According to the invention there is provided a process for preparing tobacco stem for use as filler for a smoking article comprising:

classifying the tobacco stem to provide a plurality of stem grades;

rolling each stem grade separately, each grade being rolled under rolling conditions optimised for that grade. It is preferred that the rolling conditions for each grade are such that the resulting rolled stems of all grades are of a substantially uniform thickness. It is also preferred that the classification is according to the position on the tobacco plant of the leaf from which the stem originated.

Alternatively, the classification is according to stem diameter. Most preferably, the classification is according to the position on the tobacco plant of the leaf from which the stem originated and then by further classifying each resulting grade of stem prior to rolling according to stem diameter to produce the plurality of grades for rolling. Also preferably, the classification according to the position on the tobacco plant of the leaf from which the stem originated is conducted on cured tobacco leaves prior to threshing.

It is also preferred that a further classification is carried out on the green flat rolled stems, preferably before drying; this classification (cleaning) may be by air separation, and can produce a grade of rolled stem suitable for direct use for primary processing into filler without drying, and a by-product suitable for the manufacture of tobacco sheet. After drying, a further stem classification, similar to the previously described classification, can be conducted on the dried rolled stem.

All the processing steps mentioned above (other than primary processing and manufacture of tobacco sheet) can be carried out in the stemmery prior to packaging of the rolled stem and shipping to the cigarette factory The rolled stem may be dried prior to packaging for transport, before or after any post rolling classification.

The invention also provides, in a second aspect, a process for preparing tobacco stem for use as filler for a smoking article comprising grading rolled tobacco stem into at least two grades.

The invention also provides a process for the manufacture of smoking articles such as cigarettes comprising forming cut filler made by a process according to the first or second aspects of the invention into a smoking article.

The invention also provides a smoking article comprising filler made by a process according to the first or second aspects of the invention.

BRIEF DESCRIPTION THE DRAWINGS

The invention will be further described, by way of example, with reference to the accompanying FIG. 1 which is a flow chart showing a preferred embodiment of a process according to the invention for making cigarettes.

Cured tobacco leaves are classified (1) according to their stalk position on the plant and further by leaf quality to give as many as forty grades of leaf. The classified leaf is threshed (2) to separate the lamina from the stem. This produces stem (S), by-product tobacco (P) for use in the manufacture of tobacco sheet as well as lamina (L). The lamina is treated conventionally, by drying and packaging for shipping to the cigarette factory for conventional primary processing.

The grades of green stem (S) obtained by the pre-threshing classification are subjected to a first stem classification (3) by stem diameter, length and optionally by other characteristics such as moisture content. The thus obtained grades of classified stem are rolled separately (4) to produce graded flat rolled stem. The rolling technique is well known; the stems are passed through the nip between contra-rotating rollers. However, the nip size can be adjusted to that optimal for each grade of stem, to achieve a uniform rolled stem thickness, for example of 1.1 mm. This is made easier when the stem has been classified (3) by diameter. The stem is rolled green, that is, before any post-curing drying process, although after threshing; the stem is therefore rolled at an o.v. of about 15 to 30%. If necessary, the o.v. of the stem can be adjusted before rolling, for example by conditioning with moisture. The flat rolled stem is subject to a second stem classification (5). This second stem classification is into heavy (A') and light (B') fractions, and can be done by air separation, a classification technique not previously applied to stems. Because the flat rolled stem is of substantially uniform thickness, the weight of the flat rolled stem pieces is substantially proportional to their surface area, so the second stem classification (5) serves to separate pieces (A') of larger area, suitable for direct use as cut filler, from pieces (B') of smaller area, suitable for use in the manufacture of tobacco sheet. Because the rolling conditions have been optimised for each grade of stem, the proportion of large pieces (A') to small pieces (B') is greater than after stem rolling in conventional stem treatments and the average size of the pieces is greater (see the table). This means that a greater proportion of the stem can be used directly for filler rather than as by-product for tobacco sheet, and that the average stem length of the stem directly usable as filler is greater than with conventional techniques. The stem is then dried (6).

The dried flat rolled stem may then be subjected to a third stem classification (7), which may also be by air separation. This third stem classification produces large (A") and small (B") dried flat rolled stem pieces which are both suitable for use, after primary processing, as cut rolled stem (CRS).

The larger pieces (A") of flat rolled stem are packaged (8) for shipping (9). Although the flat rolled stem is of higher o.v. than conventionally processed stem, which is dry (10 or 11% o.v., typically) at the packaging stage, the uniformity of flat rolled flat stem thickness and the mechanical strength afforded by the increased o.v. means that the stem can be packaged to a higher density, up to 25% greater than conventionally processed stem at the same o.v. This increased packaging density maintains the shape of the flat rolled stem flat during shipping (8) and protects the stem from mechanical damage.

It will be appreciated that not all the stem need be subjected to all the process steps described; for example, in addition to dried flat rolled stem, green flat rolled stem and green unrolled stem can be shipped from the stemmery directly to the cigarette factory for primary processing.

After shipping to the cigarette factory, the grades of flat rolled stem can be preblended (10) with each other and with graded flat rolled stem from other sources. The preblended stem is subjected to primary processing (11) which will include some or all of conditioning, heating, cutting and drying. Soak time for water penetration into the core of the stem is not required since the dry flat rolled stem absorbs liquid quickly compared to dry unrolled stem. The cut rolled flat stem is blended with cut lamina (12) to provide a cut filler blend which is used to manufacture cigarettes in a conventional manner (13).

It will be appreciated that the grades of stem produced by the first, green, classification (1), (3) can be mixed together if desired at any time after rolling (4); alternatively, the stem can be subjected to some or all of the primary processing steps in the grades produced by the first classifications, done before rolling, further classified by the second classification. This enables fine control of the characteristics of the final blend of cut filler to be exercised.

The following table indicates the improvement in stem length [immediately prior to primary processing] achieved by the process of the invention compared to conventional process:

| LEAF POSITION AND TOTAL % | STEM | PROCESS OF THE INVENTION | | CONVENTIONAL PROCESS | |
|---|---|---|---|---|---|
| OF STEM | LENGTH | MIN. % | MAX. % | MIN % | MAX. % |
| TOP | LONG | 18 | 24 | 15 | 20 |
| 24–27 | SHORT | 6 | 3 | 9 | 7 |
| MIDDLE | LONG | 22 | 29 | 18 | 25 |
| 29–33 | SHORT | 7 | 4 | 11 | 8 |
| BOTTOM | LONG | 19 | 27 | 16 | 22 |
| 25–30 | SHORT | 6 | 3 | 9 | 8 |

In the table "long" indicates stems having a length of at least 30 mm, preferably no longer than 50 mm, more suitable for direct use for filler production, and "short" indicates stems having a length less than 30 mm, more suitable for use in the manufacture of tobacco sheet.

In the second aspect of the invention, stem is classified after rolling. This may be done in an otherwise conventional stem treatment process in which stem is rolled as part of the primary processing, after drying and conditioning.

The invention, particularly in its first aspect, provides a process by which the yield of flat rolled stem which may be used directly as filler is increased, and by which the average stem length and thus the average length of cut filler from stem is increased. Thus, tobacco is used more efficiently. The stem may be subjected to primary processing and cutting while classified according to leaf stalk position on the plant, affording fine control of the characteristics of the blended cut filler. The invention also significantly improves the logistics of tobacco transport and handling. It allows stem to be packaged more densely for shipment, reducing shipping costs, wastage during shipping and storage costs. It has also been found that during green rolling of stem, the tobacco dust which may be produced is retained on the stem; the amount of dust produced during green rolling is anyway significantly less than during rolling after drying and reordering.

What is claimed is:

1. A process for preparing tobacco stem for use as filler for a smoking article comprising:

classifying the tobacco stem to provide a plurality of stem grades;

rolling each stem grade separately, each grade being rolled through a nip between rollers with at least one of the steps of the nip size being adjusted for each grade so as to achieve a uniform rolled stem thickness and an oven volatiles content of the stem being adjusted before the rolling.

2. A process according to claim 1 in which the rolling is carried out on green stem that has been subjected to an initial curing process but has not yet been subjected to a post curing drying process.

3. A process according to claim 1 in which the tobacco stem is classified according to a position on a tobacco plant of a leaf from which the stem originated.

4. A process according to claim 3 in which the classification according to the position on the tobacco plant of the leaf from which the stem originated is conducted on cured tobacco leaves prior to threshing.

5. A process according to claim 4 in which the tobacco stem has an oven volatiles content of between 15 and 30%.

6. A process according to claim 1 in which the classification is according to stem diameter.

7. A process according to claim 1 in which the classification is firstly according to a position on a tobacco plant of a leaf from which the stem originated to provide resulting grades of stem and then by a further stem classification of each resulting grade prior to rolling according to stem diameter to produce the plurality of grades for rolling.

8. A process according to claim 1 in which the rolling is carried out on green stem and a stem classification is conducted on the green rolled stem to provide resulting grades of stem.

9. A process according claim 8 in which said stem classification of the green rolled stem is by air separation.

10. A process according to claim 8 in which one of the grades produced by said stem classification of the green rolled stem is suitable for direct conversion to cut filler.

11. A process according to claim 8 in which one of the grades produced by said stem classification of the green rolled stem is suitable for use in the production of tobacco sheet.

12. A process according to claim 1 in which the rolled stem is dried.

13. A process according to claim 12 in which the rolled stem is dried to an oven volatiles content of between 10 and 20%.

14. A process according to claim 12 in which a stem classification is conducted on the dried rolled stem.

15. A process according claim 14 in which said stem classification of the dried rolled stem is by air separation.

16. A process according to claim 14 in which said stem classification of the dried rolled stem provides at least two grades of dried rolled stem.

17. A process according to claim 12 in which the dried rolled stem is packaged.

18. A process according to claim 1 in which the rolling is carried out in a stemmery.

19. A process according to claim 18 in which the rolled stem is green and a stem classification of the green rolled stem is carried out in the stemmery.

20. A process according to claim 19 in which the rolled stem is dried and a further stem classification of the dried rolled stem is carried out in the stemmery.

21. A process according to claim 1 in which the rolled stem is subject to further processing to form cut filler for incorporation into smoking articles.

22. A process according to claim 21 in which the further processing includes at least one of conditioning, heating, cutting and drying.

23. A process for making a smoking article comprising making cut filler according to claim 21 in which said cut filler is incorporated into a smoking article.

24. A process for preparing tobacco stem for use as a filler for a smoking article, comprising:

classifying tobacco stem to provide a plurality of stem grades;

threshing tobacco leaf to separate tobacco stem from leaf lamina;

drying the tobacco stem; and rolling each stem grade, said rolling step being performed between said threshing step and said drying step.

* * * * *